United States Patent [19]

Reddien

[11] 4,330,950

[45] May 25, 1982

[54] GOLF SHOES HAVING REPLACEMENT CLEATS

[76] Inventor: Neil P. Reddien, 143 Ames Ave., Tonawanda, N.Y. 14150

[21] Appl. No.: 198,605

[22] Filed: Oct. 20, 1980

[51] Int. Cl.[3] ..... A43B 5/00; A43C 15/00

[52] U.S. Cl. ..... 36/127; 36/67 D

[58] Field of Search ..... 36/67 R, 67 D, 127, 36/128, 59 R, 126, 129, 114

[56] References Cited

U.S. PATENT DOCUMENTS

| | | | |
|---|---|---|---|
| 2,745,197 | 5/1956 | Holt | 36/127 |
| 2,803,070 | 8/1957 | Passidomo et al. | 36/67 D |
| 3,816,945 | 6/1974 | Egtvedt | 36/114 |
| 3,824,710 | 7/1974 | Egtvedt | 36/114 |
| 4,014,114 | 3/1977 | Jordan et al. | 36/67 D |
| 4,299,038 | 11/1981 | Epple | 36/67 D |

*Primary Examiner*—Patrick D. Lawson

[57] ABSTRACT

A golf shoe, having cleats on its underside, which are replaceable after becoming worn down; each cleat including a threaded receptacle, stationarily installed in the shoe sole, and a removable prong unit, that includes a threaded shank engagable in the receptacle, an oppositely extending, tapered prong, and a circular flange having holes therethrough, for receiving nails that hold the prong unit to the shoe sole, so as to prevent the unit from turning.

3 Claims, 6 Drawing Figures

Fig. 1
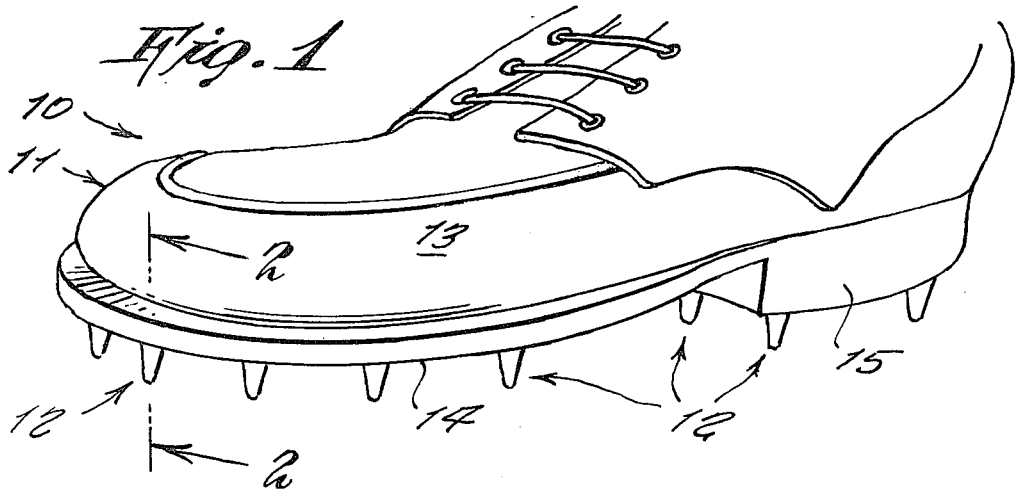
Fig. 2
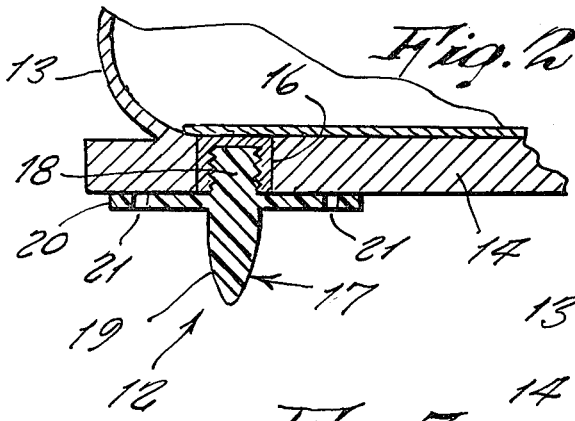
Fig. 3
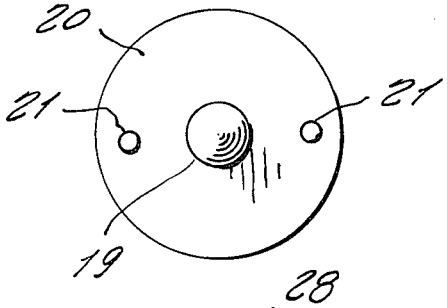
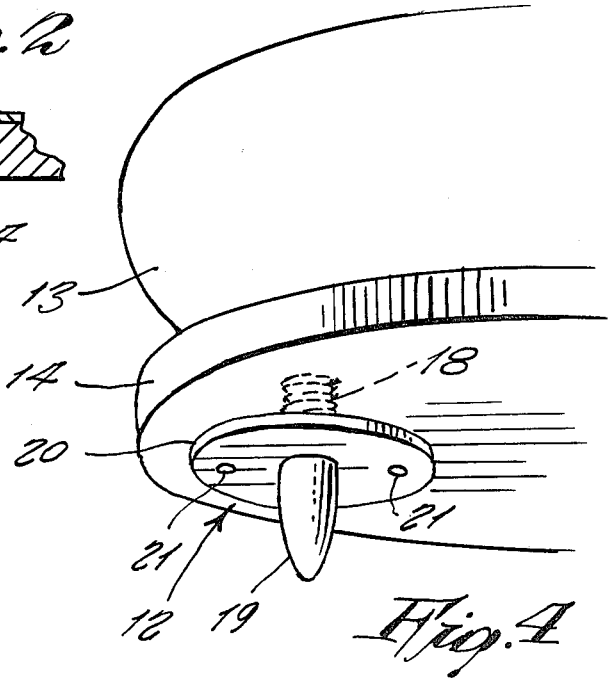
Fig. 4
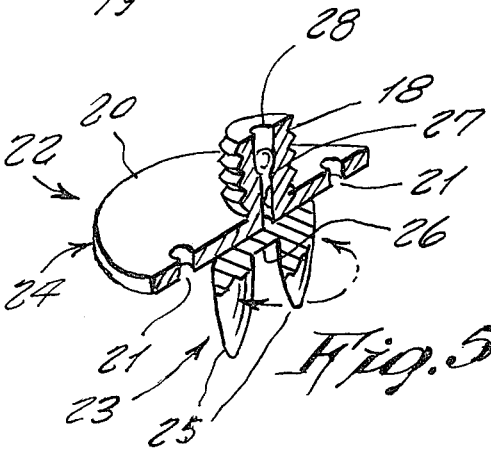
Fig. 5
Fig. 6
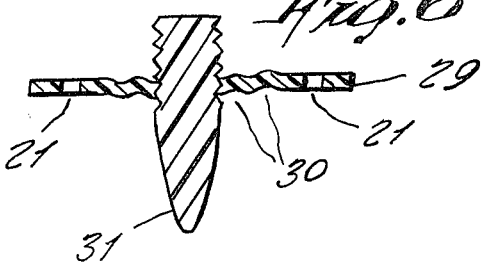

GOLF SHOES HAVING REPLACEMENT CLEATS

This invention relates generally to cleated footwear, such as golf shoes, and the like.

It is well known, that conventional golf shoes provided with cleats are made with the cleats being of metal, in order to be durable. However, such construction is objectionable, because metal cleats are a hazard, in case of a lightning storm, or in case a person steps upon downed electric wires from a storm, or steps upon any other fallen object conducting electricity. This situation is objectionable, and is, therefore, in need of an improvement.

Therefore, it is a principal object of the present invention to provide a golf shoe having cleats made of electrically non-conductive material, so that, in case of a lightning storm, a person is insulated from the wet ground, and in case of stepping upon any electrically live object, he is likewise insulated therefrom.

Another object is to provide a cleated golf shoe, wherein the insulating cleats are readily and easily replaced, after becoming worn down, in order that a sufficient distance is maintained between the bottom of the shoe and the ground or other object upon which a person may step.

Yet another object is to provide a cleated golf shoe, the principle of which could be adaptable to other cleated shoes, such as football players' shoes, shoes worn by mountain climbers, and the like.

Other objects of the present invention are to provide gold shoes having replacement cleats, which are simple in design, inexpensive to manufacture, rugged in construction, easy to use and efficient in operation.

These, and other objects, will be readily evident, upon a study of the following specification, and the accompanying drawing wherein:

FIG. 1 is a perspective view of a shoe having the replacement cleats on its underside;

FIG. 2 is an enlarged cross-sectional view, on line 2—2 of FIG. 1, and showing one of the cleats in greater detail;

FIG. 3 is a bottom view of the cleat;

FIG. 4 is a perspective view thereof;

FIG. 5 shows a modified design of the cleat, which is double-pronged, and is more shock-absorbent in use, FIG. 6 is a cross-sectional view of yet another modified design, with the plate being shock absorbent.

Referring now to the drawing in greater detail, and more particularly, to FIGS. 1 through 4 thereof, at this time, the reference numeral 10 represents a cleated golf shoe, according to the present invention, wherein there is a shoe member 11, and a plurality of cleat units 12 on an underside thereof.

The shoe includes a shoe upper 13, a sole 14 and a heel 15, the cleat units being fastened to the sole and heel thereof.

Each cleat unit 12 comprises an internally threaded receptacle 16, that is permanently imbedded within the sole or heel, and it also includes a prong unit 17, that is removably attachable thereto.

While the receptacle may be made either of metal or a hard plastic, the prong unit comprises a single member, made entirely of electrically non-conductive material, such as either a hard plastic or hard rubber. The tip of which may be coated with a metal substance or have a metal tip installed into it to increase wearability. The double cleat may be made entirely of metal or of non-conductive material. It includes an externally screw-threaded shank 18 at one end, and a tapered prong 19 at its other end, while a radially extending, circular flange 20 is therebetween; the flange including a plurality of holes 21 therethrough, for the purpose of receiving mounting nails, in order to secure the flange against an underside of the shoe sole or heel, thus preventing rotation of the unit respective to the receptacle, while being worn, so as not to become lost. However, after the prong becomes worn, the nails are easily removable, so that the unit is thus unscrewed, and replaced by a new unit.

In FIG. 5, another design of the invention includes a prong unit 22, in which the shank 18 and flange 20 are made as one piece, and a double member 23, is separately made, and is supported rotatably free on the supporting unit 24, formed by the shank and flange. In this design, two prongs 25 are located side by side, and are integral with a base plate 26, from which they extend, and which rests against an underside of the flange. An upward stem 27, of the double prong member 23, extends up into a central hole 28, formed through the shank. An upper end of the stem is enlarged and an upper end of the hole 28 is correspondingly enlarged, so that the member 23 is permanently held in the unit 24, without falling out, while being free to rotate relative thereto. One of the prongs may be made longer than the other. The double prongs give greater stability to the shoe, particularly during a normal golf club swing.

In FIG. 6, a circular plate 29 corresponds to the above-described flanges in purpose, and it includes concentric corrugations 30, so that a prong 31, held therein, can slightly flex when urged by other forces, so that the plate thus forms a shock absorber for the wearer.

While various changes may be made in the detail construction, it is understood that such changes will be within the spirit and scope of the present invention, as is defined by the appended claims.

What I now claim is:

1. A cleated golf shoe, comprising, in combination, a shoe having an upper, a sole and a heel, and a plurality of cleat units on an underside of said sole and heel, each cleat unit including a one piece shank and flange permanently affixed in said underside, a central opening in said shank, a prong unit, a stem on said prong unit, and means for mounting said stem in said central opening for rotation about said stem.

2. The combination, as set forth in claim 1, wherein said cleat units are made of electrically non-conductive material.

3. The combination as set forth in claim 1, wherein said prong unit includes a plurality of prongs.

* * * * *